US005457519A

United States Patent [19]

Morrison et al.

[11] Patent Number: 5,457,519

[45] Date of Patent: Oct. 10, 1995

[54] TWO DIMENSIONAL PROCESS CONTROL SYSTEM FOR AN ELECTROSTRATOGRAPHIC PRINTING MACHINE

[75] Inventors: Ian D. Morrison; Edward F. Grabowski, both of Webster, N.Y.

[73] Assignee: Xerox Corporation, Stamford, Conn.

[21] Appl. No.: 169,108

[22] Filed: Dec. 20, 1993

[51] Int. Cl.[6] ..... G03G 21/00

[52] U.S. Cl. ..... 355/208; 355/328

[58] Field of Search ..... 355/32.6 R, 327, 355/328, 208, 203, 207, 219, 220, 221; 324/600, 601

[56] References Cited

U.S. PATENT DOCUMENTS

| | | | |
|---|---|---|---|
| 4,318,610 | 3/1982 | Grace . | |
| 4,512,652 | 4/1985 | Buck et al. . | |
| 4,697,910 | 10/1987 | Kasuya | 355/202 |
| 4,920,024 | 4/1990 | Williams | 430/45 |
| 4,959,286 | 9/1990 | Tabb | 430/45 |
| 5,019,859 | 5/1991 | Nash | 355/77 |
| 5,045,882 | 9/1991 | Roehrs et al. | 355/208 |
| 5,119,131 | 6/1992 | Paolini et al. | 355/208 |
| 5,119,147 | 6/1992 | Hays | 355/326 R |
| 5,138,378 | 8/1992 | MacDonald et al. | 355/208 |
| 5,155,541 | 10/1992 | Loce et al. | 355/328 |
| 5,157,441 | 10/1992 | Scheuer et al. | 355/208 |

*Primary Examiner*—A. T. Grimley
*Assistant Examiner*—Thu A. Dang

[57] ABSTRACT

An electrophotographic printing machine having an imaging member with a surface adapted to move along a preselected path in a process direction, the electrophotographic printing machine includes a charge control system, incorporating charging device for applying different voltage potentials on the imaging surface in the process direction. An exposure system is provided for discharging each of the different voltage potentials with different exposure levels in a second direction substantially perpendicular to the process direction to form segments having different voltage potentials. The charging device has a coronode wire and a screen or grid wires. The charging device acts as a constant voltage charging device and, in fact, acts as an indicator of the potentials voltage on the photoreceptor. An array of electrostatic voltmeter (ESV) provides a second voltage potentials measurements to complete the requirements to estimate the electrical parameter.

14 Claims, 4 Drawing Sheets

TWO DIMENSIONAL PROCESS CONTROL SYSTEM FOR AN ELECTROSTRATOGRAPHIC PRINTING MACHINE

The present invention relates generally to an electrostatographic printing machine and, more particularly, concerns a process control system, preferably for use in a multi-color electrophotographic printing machine.

The basic reprographic process used in an electrostatographic printing machine generally involves an initial step of charging a photoconductive member to a substantially uniform potential. The charged surface of the photoconductive member is thereafter exposed to a light image of an original document to selectively dissipate the charge thereon in selected areas irradiated by the light image. This procedure records an electrostatic latent image on the photoconductive member corresponding to the informational areas contained within the original document being reproduced. The latent image is then developed by bringing a developer material including toner particles adhering triboelectrically to carrier granules into contact with the latent image. The toner particles are attracted away from the carrier granules to the latent image, forming a toner image on the photoconductive member which is subsequently transferred to a copy sheet. The copy sheet having the toner image thereon is then advanced to a fusing station for permanently affixing the toner image to the copy sheet in image configuration.

The approach utilized for multicolor electrostatographic printing is substantially identical to the process described above. However, rather than forming a single latent image on the photoconductive surface in order to reproduce an original document, as in the case of black and white printing, multiple latent images corresponding to color separations are sequentially recorded on the photoconductive surface. Each single color electrostatic latent image is developed with toner of a color complimentary thereto and the process is repeated for differently colored images with the respective toner of complimentary color. Thereafter, each single color toner image can be transferred to the copy sheet in superimposed registration with the prior toner image, creating a multi-layered toner image on the copy sheet. Finally, this multi-layered toner image is permanently affixed to the copy sheet in substantially conventional manner to form a finished color copy.

In electrostatographic machines using a drum-type or an endless belt-type photoconductive member, the photosensitive surface thereof can contain more than one image at one time as it moves through various processing stations. The portions of the photosensitive surface containing the projected images, so-called "image areas" or "pitches", are usually separated by a segment of the photosensitive surface called an inter-document space. After charging the photosensitive surface to a suitable charge level, the inter-document space segment of the photosensitive surface is generally discharged by a suitable lamp to avoid attracting toner particles at the development stations. Various areas on the photosensitive surface, therefore, will be charged to different voltage levels. For example, there will be the high voltage level of the initial charge on the photosensitive surface, a selectively discharged image area of the photosensitive surface, and a fully discharged portion of the photosensitive surface between the image areas.

A flexible photoreceptor belt, one type of photoconductive imaging member, is typically multi-layered and has a substrate, a conductive layer, an optional hole blocking layer, an optional adhesive layer, a charge generating layer, a charge transport layer, and, in some embodiments, an anti-curl backing layer or a protective overcoat. High speed electrophotographic copiers and printers use flexible photoreceptor belts to produce high quality toner images. During extended cycling of the belts, a level of reduced life is encountered, which requires belt replacement in order to continue producing high quality toner images. As a result, photoreceptor characteristics that affect the image quality of toner output images as well as photoreceptor end of life, have been identified.

Photoreceptor characteristics that affect image quality include; charge acceptance when contacted with a given charge, dark decay in rested (first cycle) and fatigued state (steady state), the discharge or photo induced discharge characteristics (PIDC) which is the relationship between the potential remaining as a function of light intensity, the spectral response characteristics and the residual potential. As photoreceptors age, they undergo conditions known as cycle-up and cycle-down. Cycle-up (residual rise) is a phenomenon in which residual potential and/or background potential keeps increasing as a function of cycles, which generally leads to increased and unacceptable background density in copies of documents. Cycle-down is a phenomenon in which the dark development potential (potential corresponding to unexposed regions of the photoreceptor) keeps decreasing as a result of dark decay as a function of cycles, which generally leads to reduced image densities in the copies of documents.

Heretofore, various method have been employed to control the electrical parameter of a photoconductive surface to ensure high print quality. Many of the methods employ one or more test patches (or sometimes referred to as control patches) on the photoconductive surface usually in the interdocument zone upon which electrical properties can be measured by capacitively coupled probes. The photoreceptor is rotated for several cycles to measure the test patch under different electrical conditions (i.e. charging potentials and exposures) for each cycle once a sufficient number of measurement points (i.e. data) are taken. A process control algorithm that resides in the control electronics uses the obtained data to predict the generalized average electrical characteristics of the entire photoreceptor. Then, the control electronics continually adjust the charging currents and the light exposure ranges so that the photoconductive surface has consistent development field.

Various systems have been designed and implemented for controlling charging processes within a printing machine. The present invention describes a method for monitoring and controlling the electrical parameter of a photoconductive member. The following disclosures may be relevant to various aspects of the present invention:

U.S. Pat. No. 4,355,885 Patentee: Nagashima Issued: Oct. 26, 1982

U.S. Pat. application Ser. No. 07/752,793 Inventor: Kreckel Filed: Aug. 30, 1991

The relevant portions of the foregoing disclosures may be briefly summarized as follows:

U.S. Pat. No. 4,355,885 discloses an image forming apparatus having a surface potential control device wherein a magnitude of a measured value of the surface potential measuring means and an aimed or target potential value are differentiated. The surface potential control device may repeat the measuring, differentiating, adding and subtracting operations, and can control the surface potential within a predetermined range for a definite number of times.

U.S. patent application Ser. No. 07/752,793 is directed toward a method for determining photoreceptor potentials wherein a surface of the photoreceptor is charged at a charging station and the charged area is rotated and stopped adjacent an electrostatic voltmeter. An electrostatic voltmeter provides measurements at different times, for determining a dark decay rate of the photoreceptor, which allows for calculation of surface potentials at other points along the photoreceptor belt.

In accordance with one aspect of the present invention, there is provided an apparatus for monitoring and controlling an electrical parameter of an imaging surface adapted to move along a preselected path in a process direction, comprising means for recording segments having different voltage potentials in a first direction and a second direction perpendicular to the first direction on the imaging surface. Means are provided for measuring the voltage potential on each of the segments to provide a voltage potential measurements of each segment. Control means, responsive to the voltage potential measured by said measuring means, for determining the electrical parameter of the imaging surface are provided.

Pursuant to another aspect of the invention, there is provided an electrophotographic printing machine having an imaging surface adapted to move along a preselected path in a process direction, comprising a charging device for applying different voltage potentials on the imaging surface in a first direction An exposure system is provided for discharging each of the different voltage potentials with different exposure levels in a second direction substantially perpendicular to the first direction to form segments having different voltage potentials. A sensor is provided for measuring the voltage potential of each of the segments to provide a voltage potential measurements. A controller, responsive to the voltage potential measured by said sensor, for determining an electrical parameter of the imaging surface is provide.

Yet another aspect of the invention, there is provided a method for monitoring and controlling electrical parameters of an imaging surface adapted to move along a preselected path, comprising the steps of charging the imaging surface so that different voltage potentials are applied on the imaging surface in a first direction. The step of discharging each of the different voltage potentials with different exposure levels in a second direction substantially perpendicular to the first direction to form segments having different voltage potentials. The step of measuring the voltage potential of each of the segments to provide a second surface voltage potential measurements. And, the step of determining the electrical parameter of the imaging surface from the measured the voltage potential on each of the segments.

Other features of the present invention will become apparent as the following description proceeds and upon reference to the drawings, in which.

Figure 4:
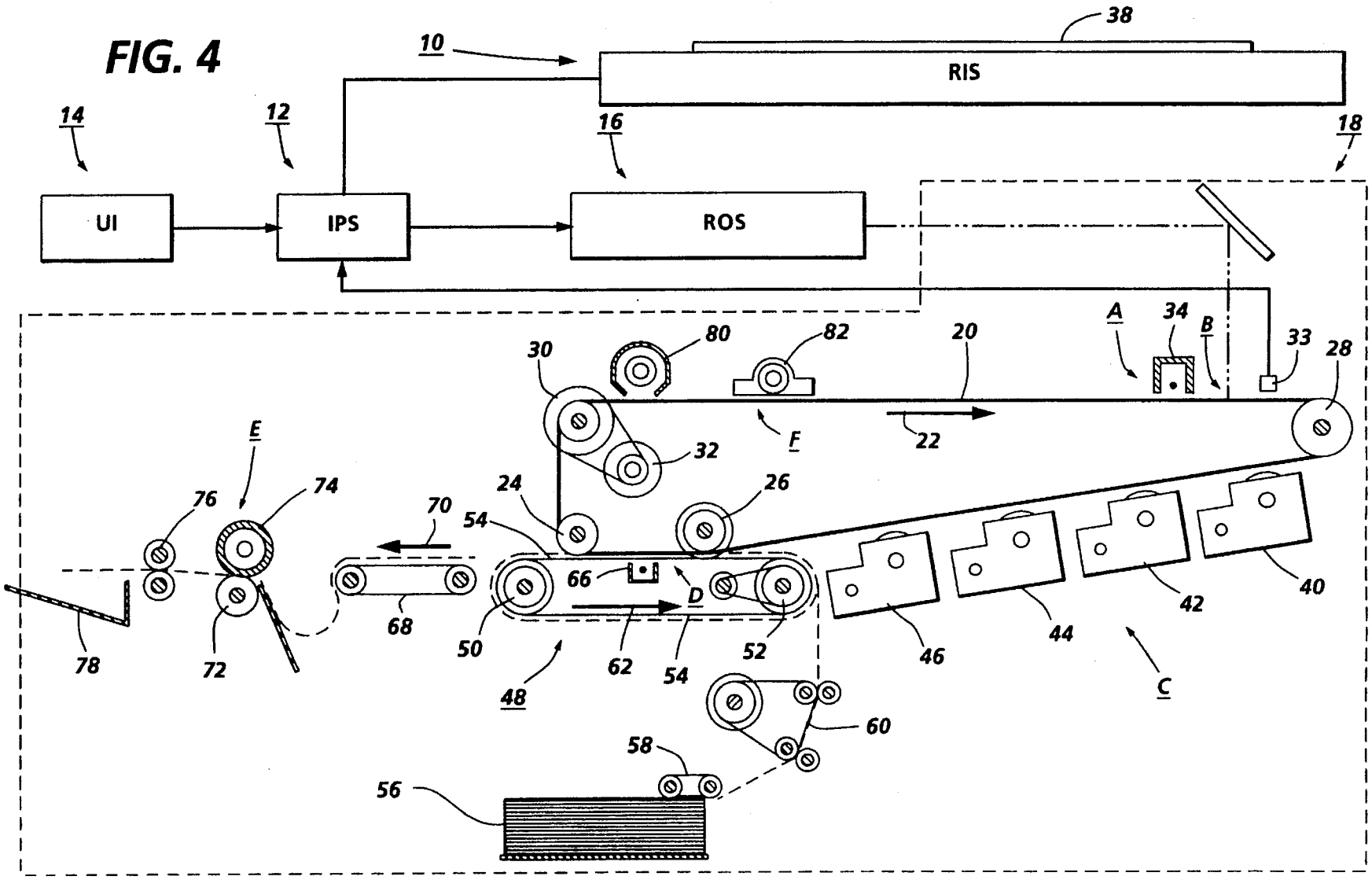
FIG. 4 is a schematic elevational view of an exemplary multi-color electrophotographic printing machine incorporating the features of the present invention therein.

While the present invention is described hereinafter with respect to a preferred embodiment, it will be understood that this detailed description is not intended to limit the scope of the invention to that embodiment. On the contrary, the description is intended to include all alternatives, modifications and equivalents as may be considered within the spirit and scope of the invention as defined by the appended claims For a general understanding of the features of the present invention, reference is made to the drawings wherein like references have been used throughout to designate identical elements. A schematic elevational view showing an exemplary electrophotographic printing machine incorporating the features of the present invention therein is shown in FIG. 4. It will become evident from the following discussion that the present invention is equally well-suited for use in a wide variety of printing systems including ionographic printing machines and discharge area development systems, as well as other more general non-printing systems providing multiple or variable outputs such that the invention is not necessarily limited in its application to the particular system shown herein.

Turning initially to FIG. 4, before describing the particular features of the present invention in detail, an exemplary electrophotographic copying apparatus will be described. The exemplary electrophotographic system may be a multicolor copier, as for example, the Xerox Corporation "5775" copier. To initiate the copying process, a multicolor original document 38 is positioned on a raster input scanner (RIS), indicated generally by the reference numeral 10. The RIS 10 contains document illumination lamps, optics, a mechanical scanning drive, and a charge coupled device (CCD array) for capturing the entire image from original document 38. The RIS 10 converts the image to a series of raster scan lines and measures a set of primary color densities, i.e. red, green and blue densities, at each point of the original document. This information is transmitted as an electrical signal to an image processing system (IPS), indicated generally by the reference numeral 12, which converts the set of red, green and blue density signals to a set of colorimetric coordinates. The IPS contains control electronics for preparing and managing the image data flow to a raster output scanner (ROS), indicated generally by the reference numeral 16.

A user interface (UI), indicated generally by the reference numeral 14, is provided for communicating with IPS 12. UI 14 enables an operator to control the various operator adjustable functions whereby the operator actuates the appropriate input keys of UI 14 to adjust the parameters of the copy. UI 14 may be a touch screen, or any other suitable device for providing an operator interface with the system. The output signal from UI 14 is transmitted to IPS 12 which then transmits signals corresponding to the desired image to ROS 16.

ROS 16 includes a laser with rotating polygon mirror blocks. The ROS 16 illuminates, via mirror 37, a charged portion of a photoconductive belt 20 of a printer or marking engine, indicated generally by the reference numeral 18. Preferably, a multi-facet polygon mirror is used to illuminate the photoreceptor belt 20 at a rate of about 400 pixels per inch. The ROS 16 exposes the photoconductive belt 20 to record a set of three subtractive primary latent images thereon corresponding to the signals transmitted from IPS 12. One latent image is to be developed with cyan developer material, another latent image is to be developed with magenta developer material, and the third latent image is to be developed with yellow developer material. These developed images are subsequently transferred to a copy sheet in superimposed registration with one another to form a multicolored image on the copy sheet which is then fused thereto to form a color copy. This process will be discussed in greater detail hereinbelow.

With continued reference to FIG. 4, marking engine 18 is an electrophotographic printing machine comprising photoconductive belt 20 which is entrained about transfer rollers 24 and 26, tensioning roller 28, and drive roller 30. Drive roller 30 is rotated by a motor or other suitable mechanism coupled to the drive roller 30 by suitable means such as a belt drive 32. As roller 30 rotates, it advances photoconductive belt 20 in the direction of arrow 22 to sequentially advance successive portions of the photoconductive belt 20 through the various processing stations disposed about the path of movement thereof.

Photoconductive belt 20 is preferably made from a polychromatic photoconductive material comprising an anti-curl layer, a supporting substrate layer and an electrophotographic imaging single layer or multi-layers. The imaging layer may contain homogeneous or heterogeneous, inorganic or organic compositions. Preferably, finely divided particles of a photoconductive inorganic or organic compound are dispersed in an electrically insulating organic resin binder. Typical photoconductive particles include trigonal selenium, metal free phthalocyanine, copper phthalocyanine, vanadyl phthalocyanine, hydroxy gallium phthalochanine, titanol phthalocyanine, quinacridones, 2,4-diamino-triazines and polynuclear aromatic quinines. Typical organic resinous binders include polycarbonates, acrylate polymers, vinyl polymers, cellulose polymers, polyesters, polysiloxanes, polyamides, polyurethanes, epoxies, and the like as well as copolymers of the above polymers.

Initially, a portion of photoconductive belt 20 passes through a charging station, indicated generally by the reference letter A. At charging station A, a corona generating device 34 or other charging device generates a charge voltage to charge photoconductive belt 20 to a relatively high, substantially uniform voltage potential. The corona generator 34 comprises a corona generating electrode, a shield partially enclosing the electrode, and a grid disposed between the belt 20 and the unenclosed portion of the electrode. The electrode charges the photoconductive surface of the belt 20 via corona discharge. The voltage potential applied to the photoconductive surface of the belt 20 is varied by controlling the voltage potential of the wire grid.

Next, the charged photoconductive surface is rotated to an exposure station, indicated generally by the reference letter B. Exposure station B receives a modulated light beam corresponding to information derived by RIS 10 having a multicolored original document 38 positioned thereat. The modulated light beam impinges on the surface of photoconductive belt 20, selectively illuminating the charged surface of photoconductive belt 20 to form an electrostatic latent image thereon. The photoconductive belt 20 is exposed three times to record three latent images representing each color.

After the electrostatic latent images have been recorded on photoconductive belt 20, the belt is advanced toward a development station, indicated generally by the reference letter C. However, before reaching the development station C, the photoconductive belt 20 passes subjacent to a voltage monitor, preferably an array or row of electrostatic voltmeters 33, for measurement of the voltage potential at the surface of the photoconductive belt 20. The electrostatic voltmeter 33 can be any suitable type known in the art wherein the charge on the photoconductive surface of the belt 20 is sensed, such as disclosed in U.S. Pat. Nos. 3,870,968; 4,205,257; or 4,853,639, the contents of which are incorporated by reference herein.

A typical electrostatic voltmeter is controlled by a switching arrangement which provides the measuring condition in which charge is induced on a probe electrode corresponding to the sensed voltage level of a control patch on the belt 20. The induced charge is proportional to the sum of the internal capacitance of the probe and its associated circuitry, relative to the probe-to-measured surface capacitance. A DC measurement circuit is combined with the electrostatic voltmeter circuit for providing an output which can be read by a conventional test meter or input to a control circuit. The voltage potential measurement of the photoconductive belt 20 is utilized to determine specific parameters for maintaining a predetermined potential on the photoreceptor surface, as will be understood with reference to the specific subject matter of the present invention, explained in detail hereinbelow.

The development station C includes four individual developer units indicated by reference numerals 40, 42, 44 and 46. The developer units are of a type generally referred to in the art as "magnetic brush development units". Typically, a magnetic brush development system employs a magnetizable developer material including magnetic carrier granules having toner particles adhering triboelectrically thereto. The developer material is continually brought through a directional flux field to form a brush of developer material. The developer material is constantly moving so as to continually provide the brush with fresh developer material. Development is achieved by bringing the brush of developer material into contact with the photoconductive surface.

Developer units 40, 42, and 44, respectively, apply toner particles of a specific color corresponding to the compliment of the specific color separated electrostatic latent image recorded on the photoconductive surface. Each of the toner particle colors is adapted to absorb light within a preselected spectral region of the electromagnetic wave spectrum. For example, an electrostatic latent image formed by discharging the portions of charge on the photoconductive belt corresponding to the green regions of the original document will record the red and blue portions as areas of relatively high charge density on photoconductive belt 20, while the green areas will be reduced to a voltage level ineffective for development. The charged areas are then made visible by having developer unit 40 apply green absorbing (magenta) toner particles onto the electrostatic latent image recorded on photoconductive belt 20. Similarly, a blue separation is developed by developer unit 42 with blue absorbing (yellow) toner particles, while the red separation is developed by developer unit 44 with red absorbing (cyan) toner particles. Developer unit 46 contains black toner particles and may be used to develop the electrostatic latent image formed from a black and white original document.

In FIG. 4, developer unit 40 is shown in the operative position with developer units 42, 44 and 46 being in the non-operative position. During development of each electrostatic latent image, only one developer unit is in the operative position, while the remaining developer units are in the non-operative position. Each of the developer units is moved into and out of an operative position. In the operative position, the magnetic brush is positioned substantially adjacent the photoconductive belt, while in the non-operative position, the magnetic brush is spaced therefrom. Thus, each electrostatic latent image or panel is developed with toner particles of the appropriate color without commingling.

After development, the toner image is moved to a transfer station, indicated generally by the reference letter D. Transfer station D includes a transfer zone, generally indicated by reference numeral 64, defining the position at which the toner image is transferred to a sheet of support material, which may be a sheet of plain paper or any other suitable support substrate. A sheet transport apparatus, indicated generally by the reference numeral 48, moves the sheet into contact with photoconductive belt 20. Sheet transport 48 has a belt 54 entrained about a pair of substantially cylindrical rollers 50 and 52. A friction retard feeder 58 advances the uppermost sheet from stack 56 onto a pre-transfer transport 60 for advancing a sheet to sheet transport 48 in synchronism with the movement thereof so that the leading edge of the sheet arrives at a preselected position, i.e. a loading zone. The sheet is received by the sheet transport 48 for movement therewith in a recirculating path. As belt 54 of transport 48 moves in the direction of arrow 62, the sheet is moved into contact with the photoconductive belt 20, in synchronism with the toner image developed thereon.

In transfer zone 64, a corona generating device 66 sprays ions onto the backside of the sheet so as to charge the sheet to the proper magnitude and polarity for attracting the toner image from photoconductive belt 20 thereto. The sheet remains secured to the sheet gripper so as to move in a recirculating path for three cycles. In this manner, three different color toner images are transferred to the sheet in superimposed registration with one another. Each of the electrostatic latent images recorded on the photoconductive surface is developed with the appropriately colored toner and transferred, in superimposed registration with one another, to the sheet for forming the multi-color copy of the colored original document. One skilled in the art will appreciate that the sheet may move in a recirculating path for four cycles when undercolor black removal is used.

After the last transfer operation, the sheet transport system directs the sheet to a vacuum conveyor, indicated generally by the reference numeral 68. Vacuum conveyor 68 transports the sheet, in the direction of arrow 70, to a fusing station, indicated generally by the reference letter E, where the transferred toner image is permanently fused to the sheet. The fusing station includes a heated fuser roll 74 and a pressure roll 72. The sheet passes through the nip defined by fuser roll 74 and pressure roll 72. The toner image contacts fuser roll 74 so as to be affixed to the sheet. Thereafter, the sheet is advanced by a pair of rolls 76 to a catch tray 78 for subsequent removal therefrom by the machine operator.

The last processing station in the direction of movement of belt 20, as indicated by arrow 22, is a cleaning station, indicated generally by the reference letter F. A lamp 80 illuminates the surface of photoconductive belt 20 to remove any residual charge remaining thereon. Thereafter, a rotatably mounted fibrous brush 82 is positioned in the cleaning station and maintained in contact with photoconductive belt 20 to remove residual toner particles remaining from the transfer operation prior to the start of the next successive imaging cycle.

The foregoing description should be sufficient for purposes of the present application for patent to illustrate the general operation of an electrophotographic printing machine incorporating the features of the present invention. As described, an electrophotographic printing system may take the form of any of several well known devices or systems. Variations of specific electrophotographic processing subsystems or processes may be expected without affecting the operation of the present invention.

The concept of the present invention is to utilize a two dimensional control patch in a control system. In essence the two dimensional control patch which consist of varying the charging level from low to high in one direction and varying the exposure from low to high in the other direction within the interdocument area of the photoreceptor. An array of electrostatic voltmeters (ESV) measures various points on the control patch, real data points are used (as opposed to predicted or expolated points) in order to obtain a precise condition of the photoreceptor as it ages. A most significant and important feature of the present invention is the ability to place the two dimensional control patch during a first cycle of rotation of the photoreceptor to obtain real time electrical characteristics of an image area and to adjust the electrical characteristics during a second cycle to the image area to be charged, exposed and developed, respectively. The description of the preferred embodiment assumes the use of a charging device of the type having a coronode wire and a screen or grid wires. The charging device acts as a constant voltage charging device and, in fact, acts as an indicator of the voltage on the photoreceptor. Such devices are well known in the art. A suitable charging device is disclosed in U.S. Pat. No. 4,868,907 which is incorporated by reference herein. The array of electrostatic voltmeter (ESV) provides a second voltage measurement to complete the requirements to estimate the electrical parameter. It will be understood by one of skill in the art that another embodiment could use two arrays of electrostatic voltmeters to provide the data used to estimate the electrical parameter.

Figure 1:
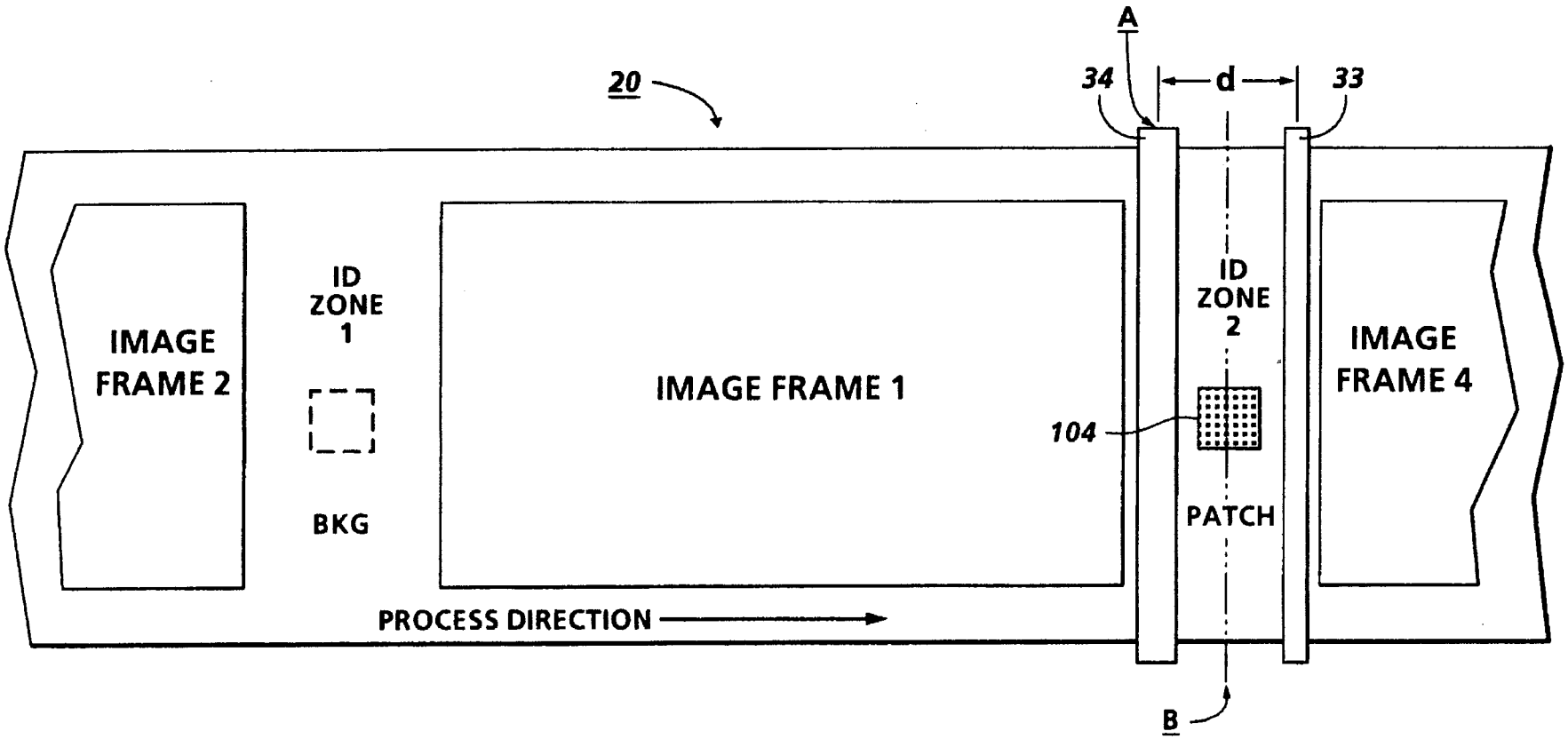
FIG. 1 is a fragmentary plan view of a photoconductive belt used in the present invention.
Figure 2:
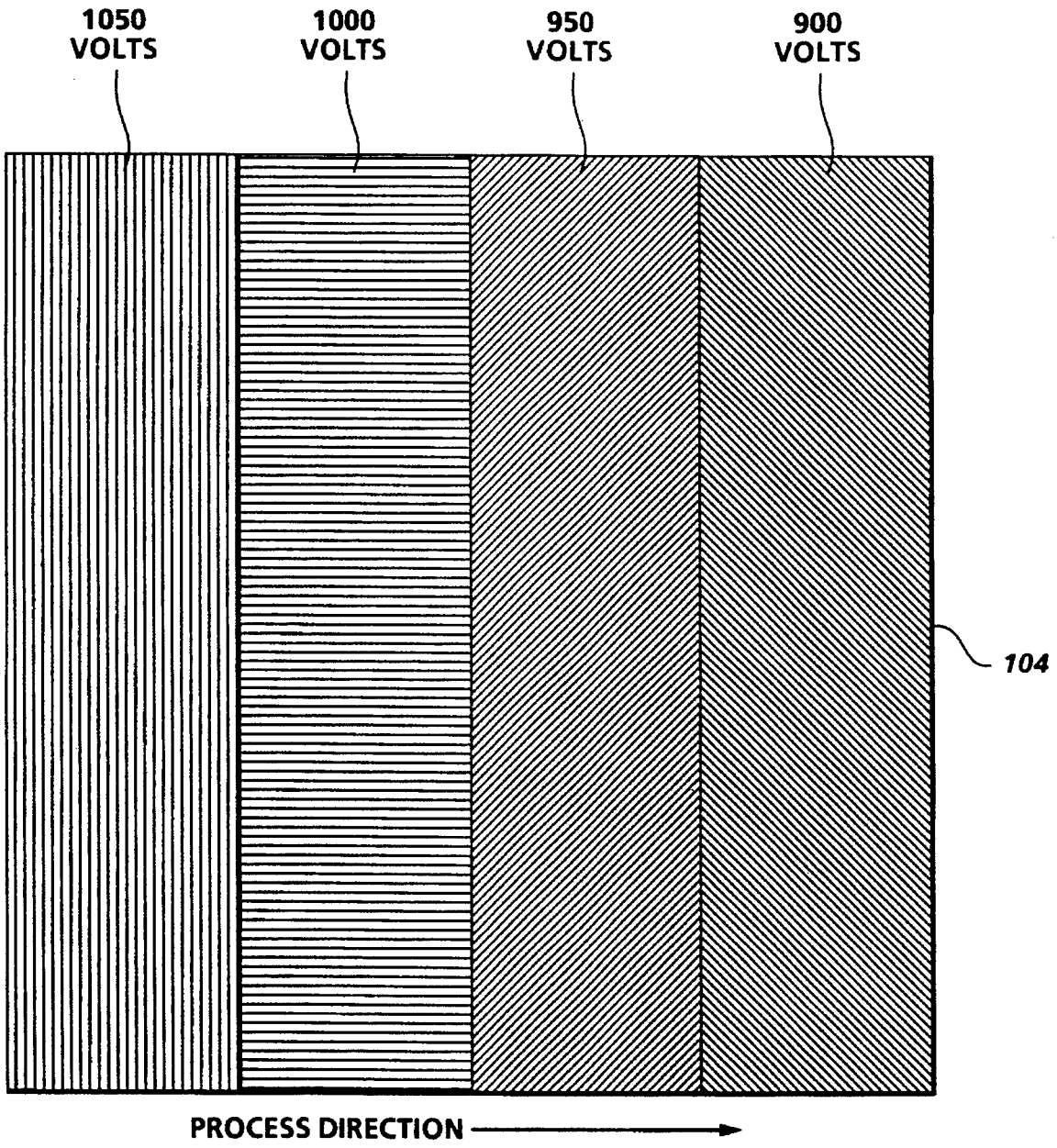
FIG. 2 is a plan view of a control patch on the FIG. 1 photoconductive belt.
Figure 3:
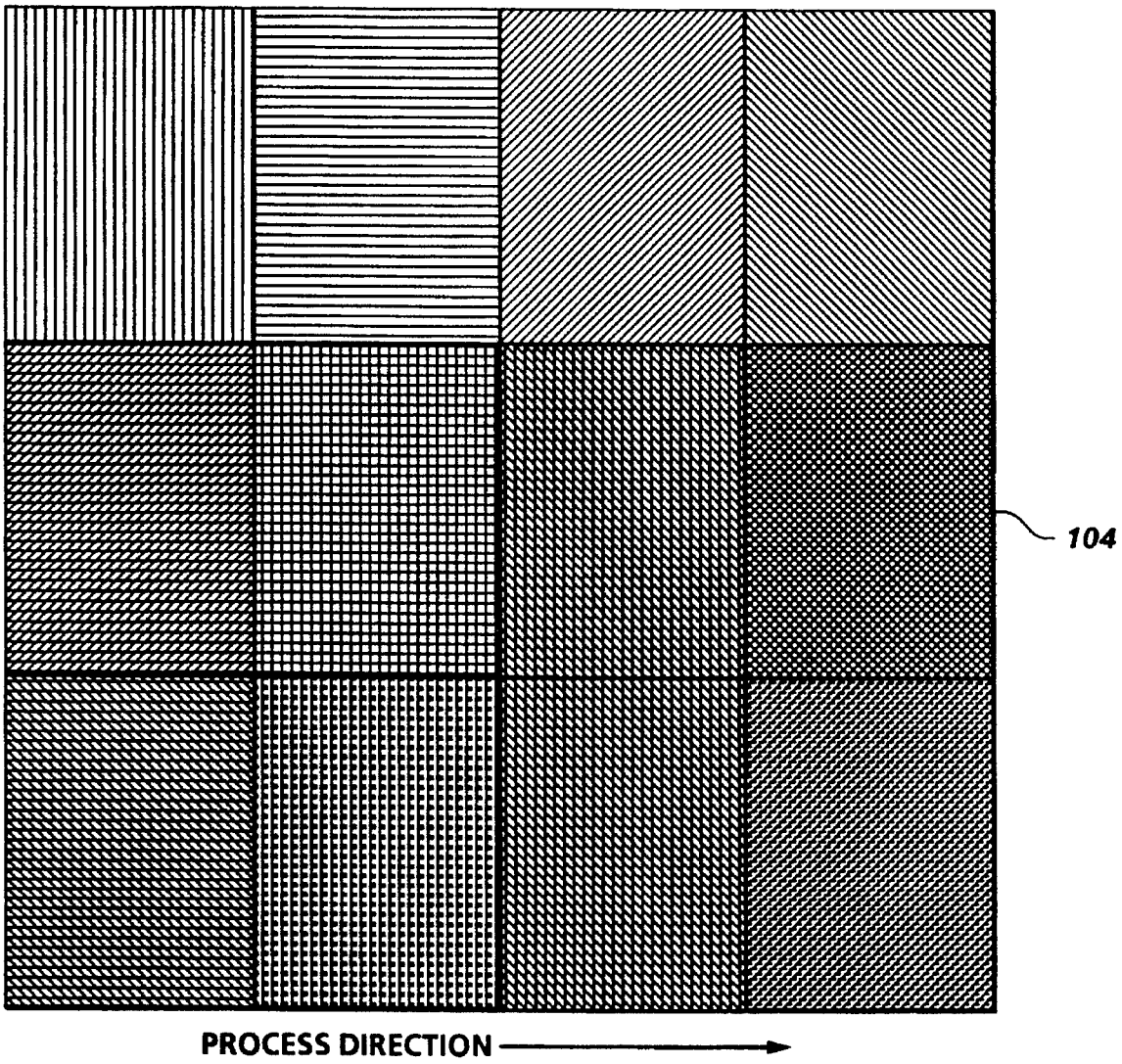
FIG. 3 is a plan view of a control patch on the FIG. 1 photoconductive belt.

During a first cycle of rotation of photoreceptor 20, the two dimensional control patch 104 is generated by charging a segment of the photoreceptor surface at charging station A. Corona generator 39 charges the segment so that the surface voltage potential on the segment has several charge levels, preferably the surface voltage potential is varied stepwise (i.e 900, 950, 1000 . . . etc) on the segment in the process direction (see FIG. 3, each hatching represent different voltage potentials of the patch). The charged segment on the photoreceptor surface is advanced in the direction of the exposure station B where the segment is exposed by the ROS 16. The ROS is modulated to vary intensities of the exposure and exposes several areas on the segment in the direction perpendicular to the process direction to different exposure levels, preferably the exposure is varied stepwise (i.e 1, 2, 3 ergs, . . . etc) to produce a control patch with a matrix of charge versus exposure level to be measured by electrostatic volt 33 (see FIG. 4). A portion of the charged segment is not exposed by the ROS. The exposed charged segment of the photoreceptor surface is advanced in the direction of the arrow to electrostatic voltmeters 33 where the electrostatic voltmeters measure the surface potential on each exposed and non exposed area on the charged segment. The measured surface potential of each exposed and non exposed area are sent to the IPS for processing.

The electrical parameters on the photoreceptor is calculated by the IPS 12. For example, Dark decay is determined by using the measurements on the nonexposed areas of the segment. The surface potential each charged area of the segment on the photoreceptor at the instant of charging ($V_{On}$) and at the point of measurement by the ESV ($V_{ESVn}$), in combination with the known distance between these points, provides the data necessary for determining the rate of dark decay of the charged surface. For a known photoreceptor material, these two 9points provide the information necessary to determine a dark decay model representing the voltage decay on the photoreceptor relative to a given charge voltage with respect to time. An efficient way to determine a dark decay model representing the voltage decay on the photoreceptor relative to a given charge voltage with respect to time is disclosed in U.S. application Ser. No. 07/904,926 to Micheal Parisi, assigned to Xerox Corporation and filed on Jun. 26, 1992, is hereby incorporated herein by reference thereto. Similarly, a series of PIDCs are determined by using the measurements on the nonexposed and exposed areas of the segment. Each PIDC is obtained by plotting the potentials as a function of exposure for each charge level of the segment.

During a second cycle of rotation of photoreceptor 20, IPS 20 uses the obtained data to continually adjust charging currents and light exposure ranges so that the photoconductive surface has consistent development field. Efficient ways for adjust charging currents and light exposure ranges so that the photoconductive surface has consistent development field are known, for example U.S. Pat. No. 5,016,050 to Roehrs et al. discloses such a technique, and is hereby incorporated herein by reference thereto.

It should be evident that the two-dimensional control patch could be non continuous. Further, the control patch could be measured periodically. Moreover, it is evident that the two-dimensional control patch could be toned and the behavior monitored by optical (or magnetic) changes.

It is, therefore, apparent that there has been provided in accordance with the present invention, a two dimensional process control system for an electrophotographic printing machine that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

We claim:

1. An apparatus for monitoring and controlling an electrical parameter of an imaging surface adapted to move along a preselected path in a process direction, comprising:

means for recording segments in a first direction having different voltage potentials and segments in a second direction perpendicular to the first direction having different voltage potentials on the imaging surface wherein said recording means includes, a charging device for applying different voltage potentials on the imaging surface in the process direction and an exposure system for discharging each of the different voltage potentials with different exposure levels in a second direction substantially perpendicular to the process direction to form the segments having different voltage potentials;

means for measuring the voltage potential on each of the segments to provide a voltage potential measurement of each segment; and control means, responsive to the voltage potential measured by said measuring means, for determining the electrical parameter of the imaging surface.

2. The apparatus of claim 1, further comprising means for adjusting said recording means, in response to the electrical parameter determined by said control means.

3. The apparatus of claim 1, wherein said measuring means includes an array of electrostatic voltmeters.

4. The apparatus of claim 3, wherein said charging device includes a control grid,

5. The apparatus of claim 1, wherein said control means determines the electrical parameter of the imaging surface during a first cycle and, during a second cycle said adjusting means adjust said recording means.

6. An electrophotographic printing machine having an imaging surface adapted to move along a preselected path in a process direction, comprising:

a charging device for applying different voltage potentials on the imaging surface in a first direction;

an exposure system for discharging each of the different voltage potentials with different exposure levels in a second direction substantially perpendicular to the first direction to form segments having different voltage potentials;

a sensor for measuring the voltage potential of each of the segments to provide a voltage potential measurement; and a controller, responsive to the voltage potential measured by said sensor, for determining an electrical parameter of the imaging surface.

7. The electrophotographic printing machine of claim 6, further comprising a setup system, responsive to said controller, for adjusting, at a selected location on the imaging surface, the voltage potential as a function of the voltage potential applied by said charging device on the imaging surface and the exposure levels applied on the imaging surface by said charging device.

8. The electrophotographic printing machine of claim 6, wherein said first direction is the process direction.

9. The electrophotographic printing machine of claim 6, wherein said charging device includes a control grid.

10. The electrophotographic printing machine of claim 6, wherein said sensor comprises an array of electrostatic voltmeters.

11. The electrophotographic printing machine of claim 10, wherein said controller determines the electrical parameter of the imaging surface during a first cycle and said setup system adjusts the voltage potential and exposure level on the imaging surface.

12. A method for monitoring and controlling an electrical parameter of an imaging surface adapted to move along a preselected path, comprising the steps of:

charging the imaging surface so that different voltage potentials are applied on the imaging surface in a first direction;

discharging each of the different voltage potentials with different exposure levels in a second direction substantially perpendicular to the first direction to form segments having different voltage potentials;

measuring the voltage potential of each of the segments to provide a second surface voltage potential measurements; and determining the electrical parameter of the imaging surface from the measured the voltage potential on each of the segments.

13. The method of claim 12, further comprising the step of adjusting the charging and exposure system at a selected location on the imaging member, in response to the electrical parameters determined in said determining step.

14. The method of claim 13, wherein said steps of charging, exposing and measuring occur during a first cycle of the imaging surface, and said step of adjusting occurs during a second cycle of the imaging surface.

* * * * *